United States Patent [19]

Campbell

[11] Patent Number: 4,741,139

[45] Date of Patent: May 3, 1988

[54] PREFABRICATED BUILDING PANEL

[75] Inventor: Henry F. Campbell, 9301 Michigan Ave., Detroit, Mich. 48210

[73] Assignee: Henry Fred Campbell, Birmingham, Mich.

[21] Appl. No.: 917,250

[22] Filed: Oct. 8, 1986

Related U.S. Application Data

[63] Continuation of Ser. No. 783,062, Oct. 2, 1985, which is a continuation of Ser. No. 583,149, Feb. 24, 1984.

[51] Int. Cl.[4] ..... E04B 5/00

[52] U.S. Cl. ..... 52/408; 52/537; 52/544; 52/796; 52/694

[58] Field of Search ..... 52/795, 796, 801, 293, 52/522, 537

[56] References Cited

U.S. PATENT DOCUMENTS

| | | | |
|---|---|---|---|
| 1,989,259 | 1/1935 | Becker | 52/796 |
| 2,050,074 | 8/1936 | Trytten | 52/796 |
| 3,842,560 | 10/1974 | Campbell | 52/694 X |
| 3,882,653 | 5/1975 | Ollman | 52/694 |
| 4,285,182 | 8/1981 | Dinges | 52/726 X |
| 4,295,312 | 10/1981 | Campbell | 52/408 |
| 4,309,853 | 1/1982 | Lowe | 52/537 X |
| 4,400,922 | 8/1983 | Boyer | 52/544 X |
| 4,466,224 | 8/1984 | Hague | 52/478 |

FOREIGN PATENT DOCUMENTS 1079026 11/1954 France .

*Primary Examiner*—Carl D. Friedman
*Assistant Examiner*—Creighton Smith
*Attorney, Agent, or Firm*—Barnes, Kisselle, Raisch, Choate, Whittemore & Hulbert

[57] ABSTRACT

A prefabricated building panel comprising a plurality of longitudinally extending transversely spaced trusses, each truss comprising opposed channel members and undulating truss member joined to and extending between the channel members. One of the channel members of each truss is fastened to a sheet. A plurality of spring clips are fastened to the other of the channels at longitudinally spaced points. Each clip includes wings extending transversely of the channel. A second sheet is provided and has longitudinally extending grooves with the grooves having a configuration such that the spring clips extend into the grooves and the wings engage portions of the grooves to laterally restrain the sheet.

7 Claims, 4 Drawing Sheets

PREFABRICATED BUILDING PANEL

This application is a continuation of application Ser. No. 783,062, filed Oct. 2, 1985 which is, in turn, a continuation of application Ser. No. 583,149, filed Feb. 24, 1984.

This invention relates to building construction and particularly to prefabricated building panels.

BACKGROUND AND SUMMARY OF THE INVENTION

In the making or reconstruction of buildings, a major expense is the cost of erection of walls and ceilings.

In order to minimize labor and cost, it has been heretofore suggested that prefabricated panels be provided.

Among the objectives of the present invention are to provide a prefabricated panel which is strong yet necessitates less material, is lower in cost and easier to construct.

In accordance with the invention, the prefabricated panel comprises a plurality of longitudinally extending transversely spaced trusses, each truss comprising opposed channel members and undulating truss member joined to and extending between the channel members. One of the channel members of each truss is fastened to a sheet having a groove receiving the channel. A plurality of clips are fastened to the other of the channels at longitudinally spaced points. Each clip includes wings extending tranversely of the channel. A second sheet is provided and has longitudinally extending grooves having a configuration such that the spring clips extend into the grooves and the wings engage portions of the grooves to laterally restrain the sheet.

DESCRIPTION

Figure 1:
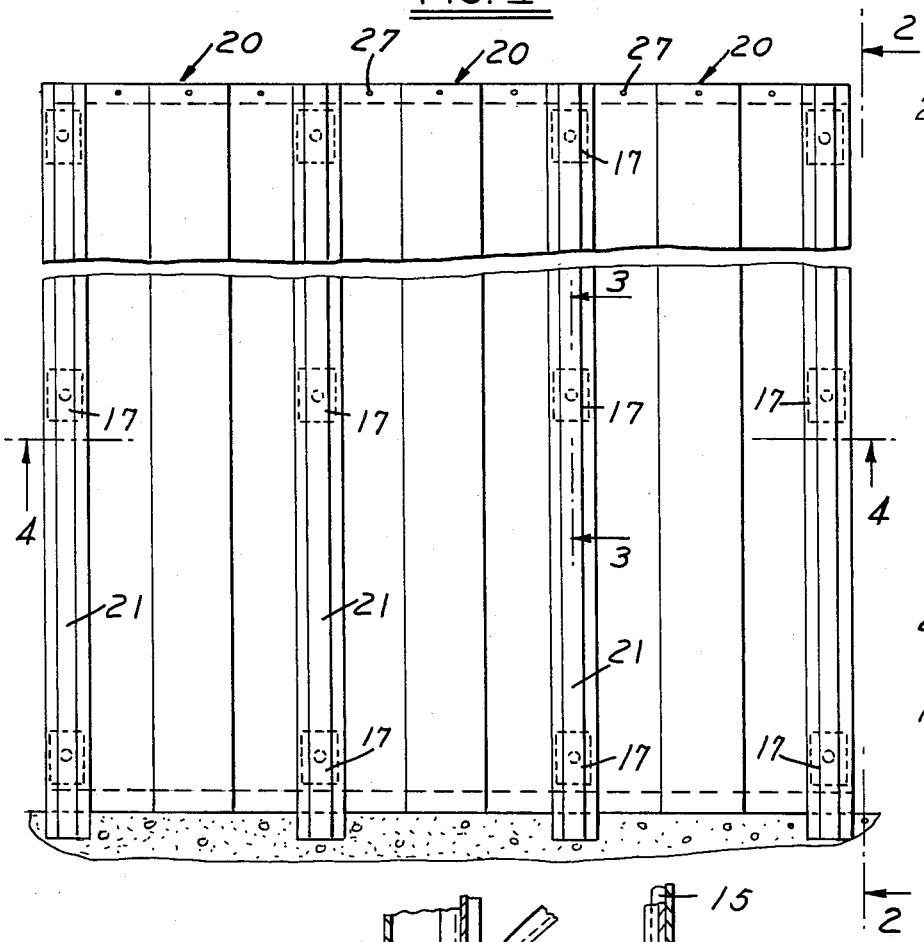
FIG. 1 is a side elevational view of a building embodying the invention.

Referring to FIGS. 1–8, the prefabricated building panel 10 embodying the invention comprises a plurality of prefabricated trusses T. Each truss comprising an outer channel 12 and an inner channel 13 with an undulating member 14 fixed to the truss each channel has a base 100. The truss T is made of metal and is more fully described in U.S. Pat. No. 3,882,653 that is incorporated herein by reference.

The trusses T are provided in transversely spaced relation to one another with the channel 13 extending into spaced grooves 15 of a first or inner sheet 16 and fastened thereto as by welding, adhesives or riveting. Clips 17 are fastened by riveting or welding at longitudinally spaced points to the upper channel 12 of each truss T. The clips 17 are made of spring steel and include laterally extending wings 18. Clips 17 may be of the type shown in U.S. Pat. No. 4,285,182.

In the assembly of the panel, a preshaped metal sheet 20 is positioned over the clips 17. Sheet 20 includes a plurality of grooves 21 each of which has a configuration that includes a central base portion 22, inclined wall portions 23 and inwardly extending flanges 24 terminating in the plane of the sheet. When the sheet is provided over the clips 17, the wings 18 snap into position above the flanges 24 and the lower ends of the flanges 24 engage the upper channel 12.

Figure 2:
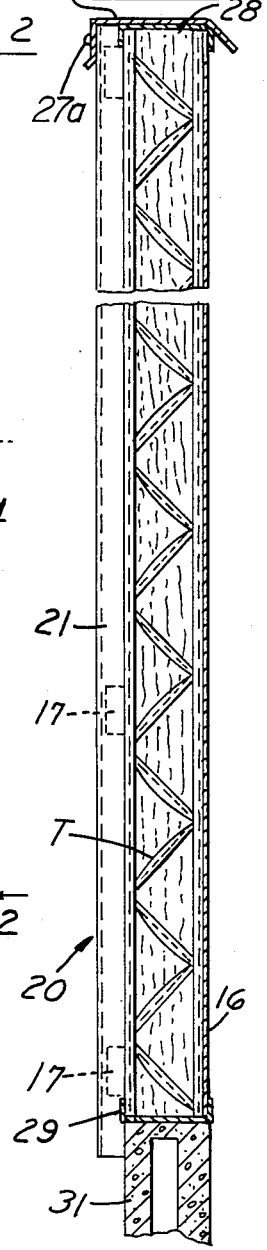
FIG. 2 is a fragmentary view on an enlarged scale taken along the line 2—2 in FIG. 1.
Figure 3:
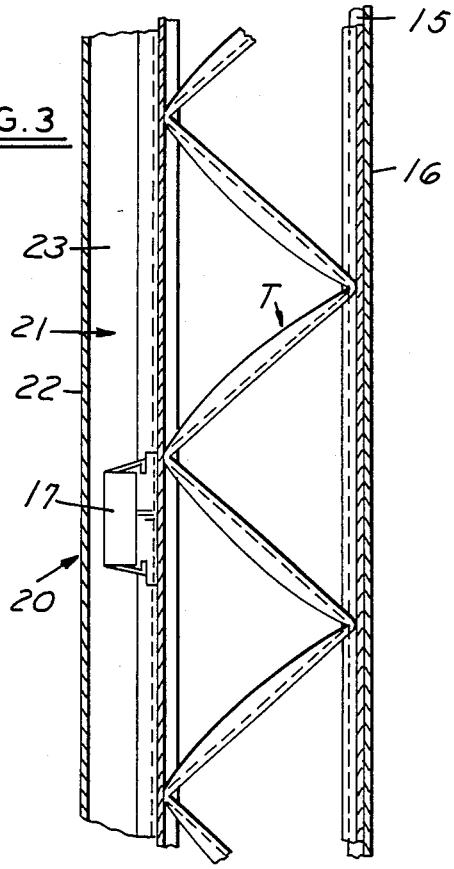
FIG. 3 is a fragmentary sectional view on an enlarged scale taken along the line 3—3 in FIG. 1.
Figure 4:
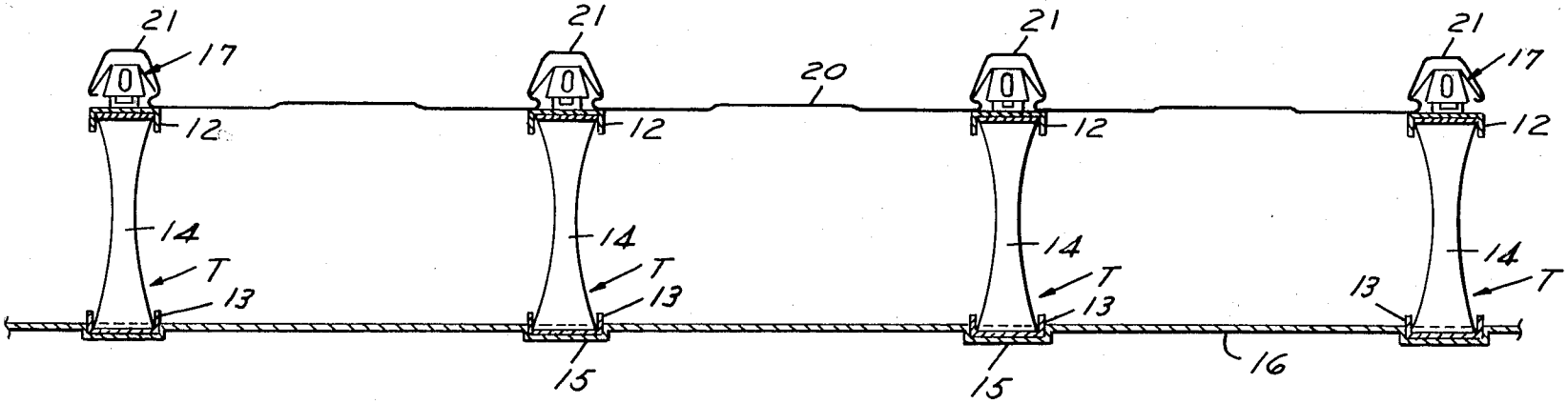
FIG. 4 is a fragmentary sectional view on an enlarged scale taken along the line 4—4 in FIG. 1.
Figure 5:
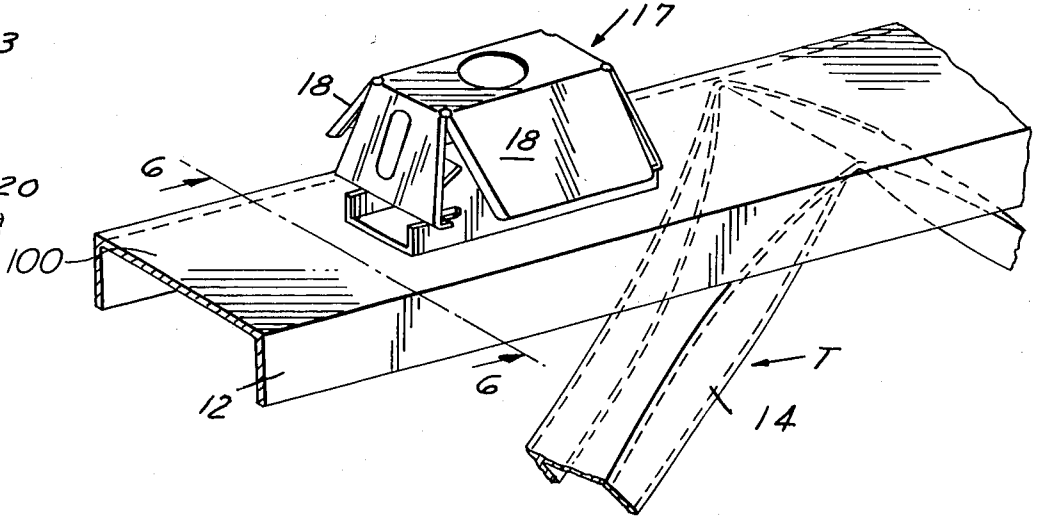
FIG. 5 is a fragmentary perspective view of a portion of the panel with parts being broken away.
Figure 6:
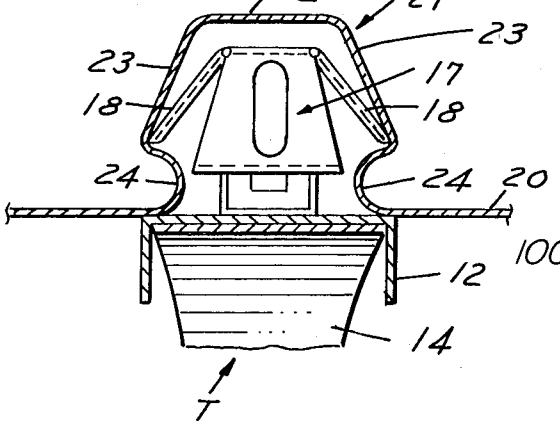
FIG. 6 is a fragmentary sectional view taken along the line 6—6 in FIG. 5.
Figure 7:
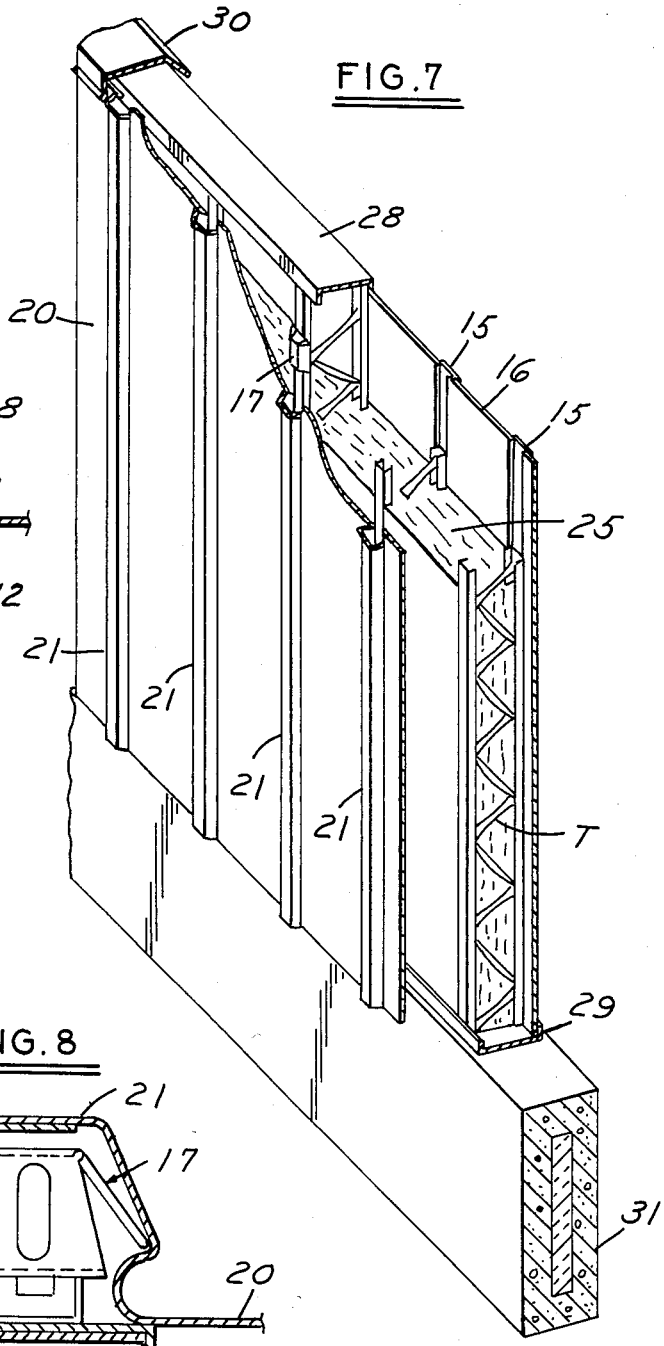
FIG. 7 is a fragmentary perspective view of a vertical wall construction embodying the invention.
Figure 8:
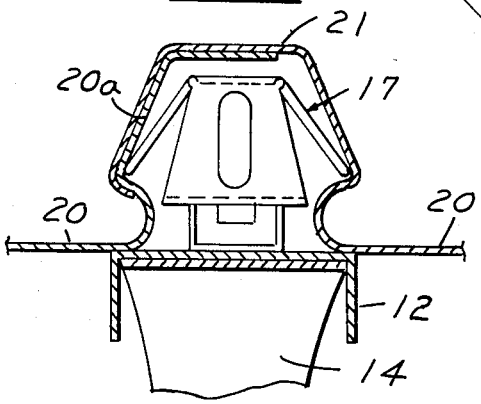
FIG. 8 is a fragmentary sectional view showing the connection between the panels.

As shown in FIGS. 1, 2 and 7, insulating material 25 may be interposed between the trusses to provide insulation.

The prefabricated panels can be used to make vertical walls as shown in FIG. 7. Prefabricated panels 10 are provided wherein a plurality of trusses T are positioned in laterally spaced relation. The trusses T are fastened to the channels 13 by screws, adhesives or rivets. Screws 27 extend through sheet 20 into cap 28 to hold the upper end of the sheet 20 on the panel. The lower end of the sheet 20 extends downwardly over the flange of a lower transverse channel 29 and is not fixed relative to the upper transverse channel 28 so that expansion can occur longitudinally downwardly as viewed in FIGS. 2 and 7. When in place, a cap 30 can be provided over the panel and held in position by screws *27a* which extend through the base portions 22 of the sheet 20. The panels can be positioned on the job site in side-by-side relation and desired, for example, on a base 31.

In order to provide a joint between adjacent panels the sheets 20 of adjacent panels are extended as at *20a* along one edge to fit within a groove 21 of the adjacent panel.

Figure 9:
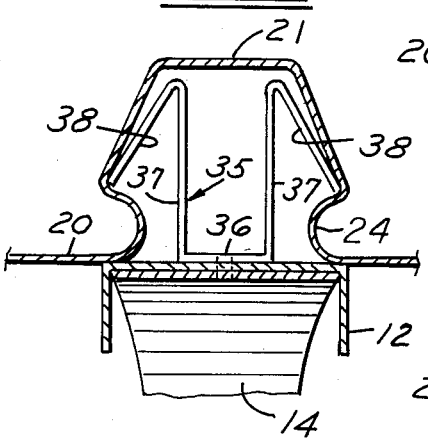
FIG. 9 is a fragmentary sectional view similar to FIG. 6 of a modified form of prefabricated panels.

A modified structure as shown in FIG. 9 comprises spring clips 35 which are made from a single piece of spring metal best to form a base 36 riveted to channel 12, wall portions 37 extending from the edges of base 36 and wings 38 extending from the edges of wall portions 37 to engage flanges 24.

Figure 10:
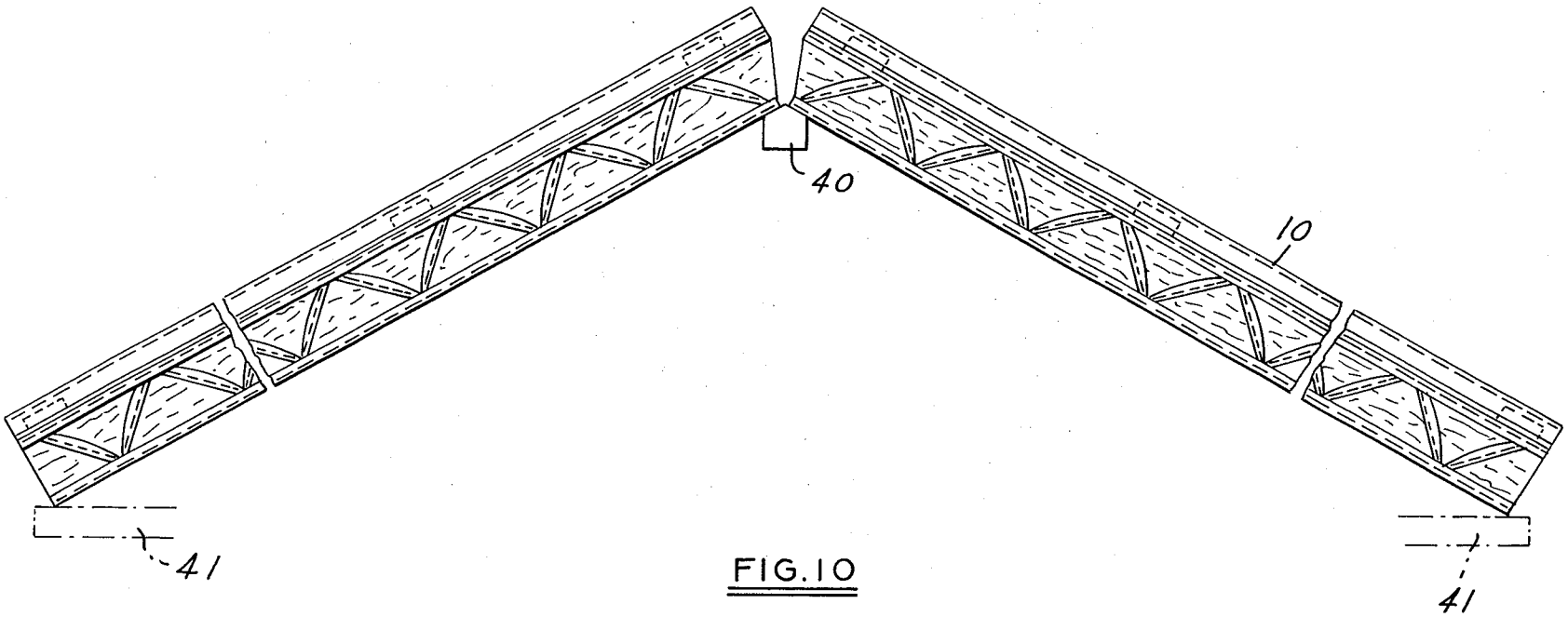
FIG. 10 is an elevational view showing the use of the prefabricated panels to form a roof.

As shown in FIG. 10, a plurality of panels 10 are provided in side-by-side relation and fastened on purlins 40, 41 by suitble means with the trusses T extending in the direction of the slope of the roof.

Although in the preferred form the trusses comprise spaced channels 12, 13 and undulating member 14, the invention is also applicable to other types of trusses which include spaced base portions and an intervening web portion or trusses such as beams having an I-section or a C-section.

I claim:

1. A prefabricated panel comprising a plurality of longitudinally extending transversely spaced trusses, each truss comprising opposed channel members and an undulating truss member joined to and extending between said channel members, each said channel member having a longitudinally extending base, a first sheet having a plurality of longitudinally extending parallel grooves, one of said channel members of each said truss extending into and fastened in at least some of said grooves, a plurality of clips fastened to at least some of the bases of said other opposed channel members of at least some of said trusses at longitudinally spaced points along said other channel members, each said clip including wings extending transversely of said other channel members, and a second sheet, said second sheet having longitudinally extending parallel grooves, said grooves on said second sheet having a configuration such that the spring clips fastened to each of said respective channel member of each of said truss extend into said groove of said second sheet and the wings engage portions of said grooves to laterally restrain the sheet, and each said grooves including inwardly extending flanges, exending longitudinally along each edge of said grooves, which are engaged by the wings of the clips, said flanges engaging the edges of the bases of the said channel members of said trusses on which said clips are fastened along substantially the entire length of the bases of said channel members, said flanges extending parallel to the bases of said channel members along substantially the entire length of the bases of said channel members.

2. The prefabricated panel set forth in claim 1 wherein each said panel has insulating material interposed between the trusses and filling the space between said sheets.

3. A prefabricated panel including a plurality of longitudinally extending transversely spaced trusses, each said truss comprising opposed channel members and an undulating truss member joined to and extending between said channel members, each said channel member having a longitudinally extending base, a plurality of clips fastened to one of said channel members of at least one of said trusses at longitudinally spaced points, each said clip including wings extending transversely of said channel member, a first sheet having longitudinally extending parallel grooves, said grooves on said first sheet having a configuration such that the spring clips extend into said grooves and the wings engage portions of said grooves to laterally restrain the first sheet, each said groove on said first sheet including inwardly exending flanges, extending longitudinally along each edge of said grooves, which are engaged by the wings of the clips, said flanges engaging the edges of the bases said channel members of said trusses along substantially the entire length of the channel members, said flanges extending parallel to the bases of said channel members along substantially the entire length of the bases of said channel members, a second sheet fastened to the other channel members of said trusses, a transverse channel having a base wall and side walls overlying and engaging said trusses and said second sheet at each end thereof, said first sheet having a portion thereof extending over and fastened to one of said transverse channels and the remainder of said first sheet extending over the other of said transverse channels and being unattached to said trusses and said other transverse channel so that it is unrestrained and may expand longitudinally of the panel.

4. A prefabricated panel comprising a plurality of longitudinally extending transversely spaced trusses, each truss comprising opposed base members and an intervening base portion joined to and extending between said base members, a first sheet, a plurality of clips fastened to at least some of said other base members of at least some of said trusses at longitudinally spaced points along said other base members, each said clip including wings extending transversely of said other base member, and a second sheet, said second sheet having longitudinally extending parallel grooves, said grooves on said second sheet having a configuration such that the spring clips fastened to said base member of each said truss extend into said respective grooves and the wings engage portions of said grooves to laterally restrain the sheet, each said groove including inwardly extending flanges, extending longitudinally along each edge of said grooves, which are engaged by the wings of the clips, said flanges engaging the edges of said base members of said trusses along substantially the entire length of the bases of said base members, said flanges extending parallel to said base members along substantially the entire length of said base members.

5. The prefabricated panel set forth in claim 4 wherein each said panel has insulating material interposed between the trusses and filling the space between said sheets.

6. A prefabricated panel comprising a plurality of longitudinally extending transversely spaced trusses, means for holding said trusses in transversely spaced parallel relationship, each truss comprising opposed channel members and an undulating truss member joined to and extending between said channel members, each said channel member having a longitudinally extending base, a plurality of clips fastened to at least some of said channel members of at least some of said trusses at longitudinally spaced points along said channel members, each said clip including wings extending transversely of said other channel members, and a sheet, said sheet having longitudinally extending parallel grooves, said grooves on said sheet having a configuration such that the spring clips fastened to each of said respective channel member of each of said truss extend into said grooves of said sheet and the wings engage portions of said grooves to laterally restrain the sheet, and each said groove including inwardly extending flanges, extending longitudinally along each edge of said grooves, which are engaged by the wings of the clips, said flanges engaging the edges of the bases of the said channel members of said trusses on which said clips are fastened along substantially the entire length of the bases of said channel members, said flanges extending parallel to the bases of said channel members and along substantially the entire length of the bases of said channel members.

7. The prefabricated panel set forth in claim 6 including insulating material interposed between the trusses and filling the space between said trusses.

* * * * *